United States Patent [19]

Ponza

[11] 4,195,614

[45] Apr. 1, 1980

[54] ROTATABLE COACTING MEMBERS FOR PROJECTING A BALL

[76] Inventor: Lorenzo J. Ponza, 910 Columbia St., Santa Cruz, Calif. 95060

[21] Appl. No.: 801,845

[22] Filed: May 31, 1977

Related U.S. Application Data

[63] Continuation of Ser. No. 579,308, May 21, 1975, abandoned.

[51] Int. Cl.[2] ..... F41B 3/04

[52] U.S. Cl. ..... 124/1; 124/81; 124/41 R

[58] Field of Search ..... 124/6, 4, 1, 41 R, 32, 124/78, 81

[56] References Cited

U.S. PATENT DOCUMENTS

| | | | |
|---|---|---|---|
| 2,112,611 | 3/1938 | Snippen | 124/78 |
| 3,399,660 | 9/1968 | Swartout | 124/6 |
| 3,766,901 | 10/1973 | Cleary et al. | 124/78 |
| 3,774,584 | 11/1973 | Paulson | 124/78 |

*Primary Examiner*—Richard C. Pinkham
*Assistant Examiner*—William R. Browne
*Attorney, Agent, or Firm*—Paul B. Fihe

[57] ABSTRACT

A ball throwing machine which includes a pair of rotary discs supported for rotation in angularly opposed relation so as to laterally engage a ball and effect propulsion thereof, each disc being composed of a back-up plate with an annular groove and a flat resilient section thereover, the discs being mounted on connected shafts enabling rotation by a single prime mover, and being capable of offset connection so that the ball will be engaged by the discs at different radial positions.

7 Claims, 7 Drawing Figures

Fig. 2
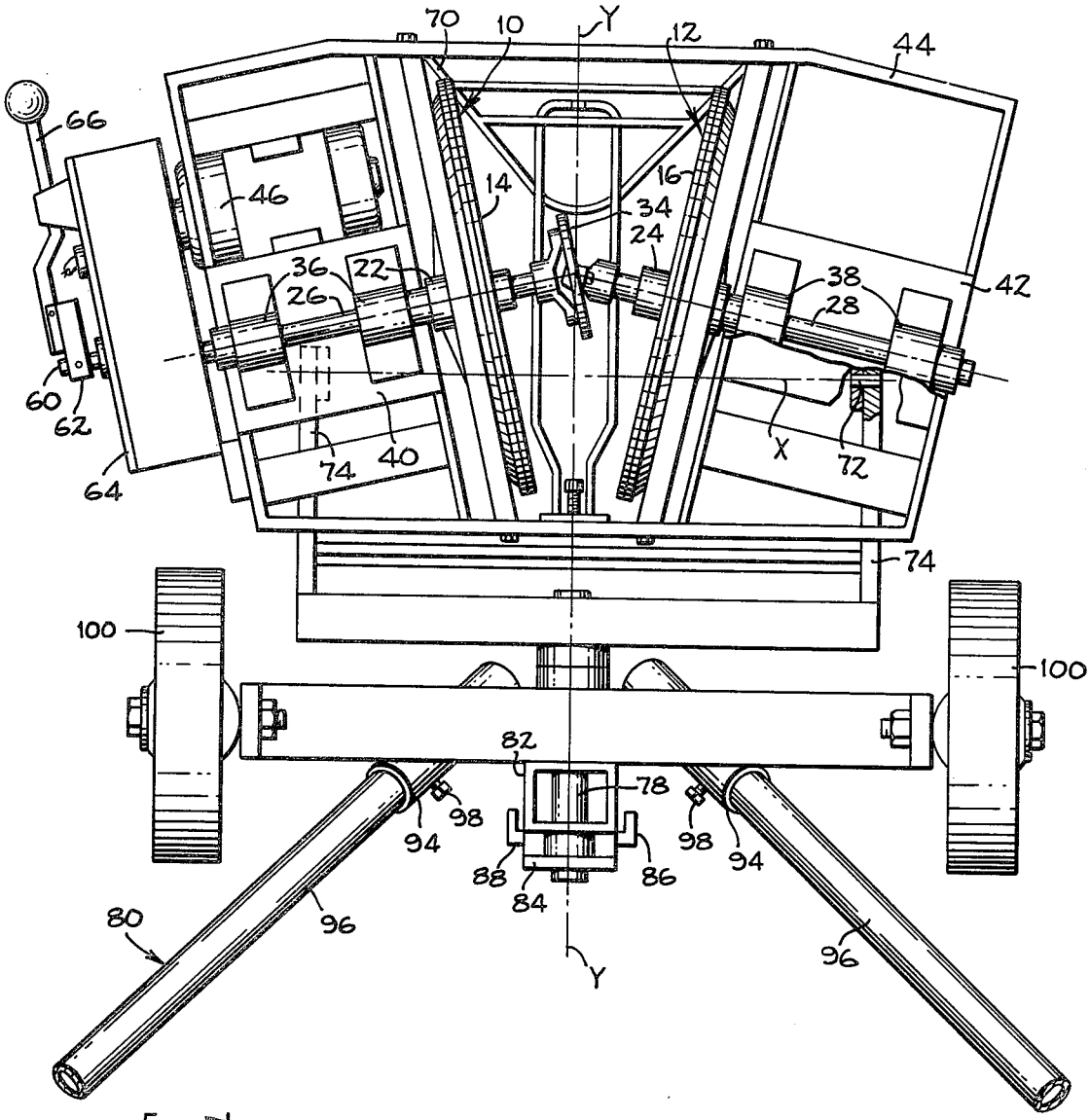
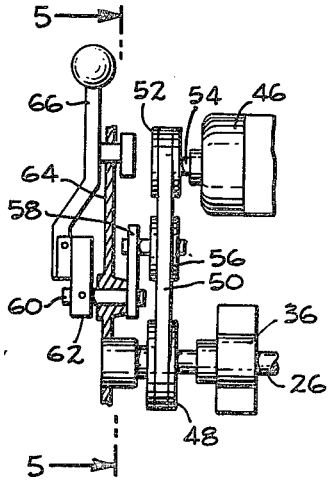
Fig. 4
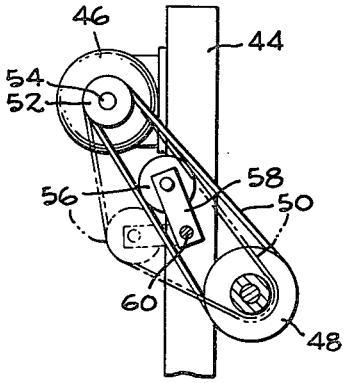
Fig. 5

ROTATABLE COACTING MEMBERS FOR PROJECTING A BALL

This is a continuation of application Ser. No. 579,308, filed May 21, 1975, now abandoned.

FIELD OF THE INVENTION

The present invention relates generally to article propelling mechanisms, and more particularly, to a machine for throwing, pitching, or otherwise propelling spherical objects such as baseballs, softballs, tennis balls, or the like.

BACKGROUND OF THE INVENTION

Various ball throwing machines are known in the prior art and have found use in amusement parks, for team batting practice, in schools, playgrounds, etc. A number of prior art devices employ a swinging arm, a mechanical impact means, or a spring-loaded device to propel the ball. With such devices, considerable difficulty has been experienced in obtaining uniform control of the ball. Generally, the prior machines throw only "straight" balls, i.e., are incapable of throwing a "curve," "slider," etc. Thus, their use has limited value for batting practice.

More recently, other known ball throwing devices employing two counter-rotating wheels have entered the field. These devices purport to have the capability of pitching a "curve" or "slider" in addition to the most required pitch in batting practice, the "straight fast ball." In these devices, the balls are projected by engagement between the confronting or opposing peripheral edges of two rotating wheels or pulleys which are arranged on their axes in parallel spaced relationship with the closest distance between the peripheries being slightly less than the diameter of the balls to be thrown.

In reality, these machines are incapable of pitching a "fast" or "straight" ball which primarily requires a vertical backspin in its trajectory. As long as the wheels rotate at different speeds, i.e. each in relation to the other, the ball will have a horizontal spinning action resulting in a "curve" ball or a "slider." When the wheels are rotating at the same speed in relation one to the other, the ball emerges with no spin at all resulting in the pure "knuckle" ball with its inherent uncontrollable and unpredictable trajectory. As a result, the most required pitch for batting practice drill, i.e. the "fast" or "straight" ball is not possible to attain with these wheel devices. On the other hand, it is also impossible with such arrangements to generate "topspin" as desired in propulsion of a tennis ball.

Furthermore, and possibly the most detrimental handicap of any peripheral wheel device with its basic horizontal wheel revolution is the danger of hitting the batter with wild pitches. Any deviation in the size of the ball, scuff marks, the ball being wet or slick, etc., results in the pitch going wildly in a horizontal or "inside" or "outside" trajectory and thereby presents a serious hazard to the batter. This handicap is rendered more serious as a result of the fact that the practical limitation on the diameters of the opposed wheel peripheries limits the period of contact with the ball and thus, the possibility of accurate control of its trajectory. Furthermore, the limitation on the period of contact requires an extremely rapid ball acceleration with attendant frictional shock and rapid deterioration and wear of the surface of the ball.

Summarizing, there have been a large number of machines for pitching or throwing balls, but none of the prior art machines have been capable of providing all of the characteristics, that is, backspin, topspin, or lateral spin which are encountered in actual playing conditions so that a decided limitation in the use of such machines for practice purposes has resulted.

SUMMARY OF THE PRESENT INVENTION

Accordingly, it is the general objective of the present invention to provide a ball throwing machine which is arranged to simulate all of the ball trajectories experienced in the actual playing of baseball, softball, tennis, and other activities wherein the controlled propulsion of a ball or similar spherical object is encountered. Briefly, such objective is achieved by providing a pair of rotary ball-contacting members having angularly opposed substantially planar ball-engaging surfaces whose spacing varies between a maximum distance greater than the diameter of the ball propelled and a minimum distance no greater than such ball diameter together with means for rotating said ball-contacting members.

In the case of tennis balls, which themselves are resilient, the ball-contacting members can be relatively rigid but in the case of essentially non-compressible balls such as baseballs or softballs, the ball-contacting members themselves are rendered resilient which can be accomplished by the simple expedient of forming the ball-contacting members of resilient material, or, alternatively, can be achieved by a resilient support of the ball-contacting members.

As is well known to any sports enthusiast, a "straight fast" ball pitched to a batter has a degree of backspin, a "curve" has a lateral spin, and primarily in the field of tennis, many balls are hit with a considerable degree of topspin. As a consequence, to provide a practice device encompassing all of such spins, the opposed angular surfaces of the ball-contacting members are arranged initially to contact each side of the ball being thrown, pitched, or otherwise propelled at radially-spaced positions relative to the axis of rotation of such ball-contacting members and since the linear speed of the contacting member varies with its radial distance, spin (topspin or backspin) is accordingly imparted to the ball itself. Secondly, in accordance with an additional aspect of the invention, the rotative speed of the two ball-contacting members can be different so as to impart a lateral spin to the propelled ball and a consequent "curve" or "slider." Alternatively, the two ball-contacting members can be rotated at the same rotative speed but can be supported at different axial positions so that the diameters differ and, as a consequence, a lateral spin will be imparted to the ball to generate a "curve" or "slider."

With such general considerations in mind, a relatively simple and inexpensive implementation of the inventive concept can take the form of a pair of ball-contacting members in the form of generally circular discs mounted for rotation on generally aligned but slightly tilted axes so that the spacing between the ball-engaging surfaces of the discs varies between a distance slightly greater than the diameter of the ball being propelled and a distance no greater than such ball diameter. The ball, itself, can be introduced in a simple fashion at a rotative position whereat the distance is greatest and will be engaged and carried by the ball-contacting members in a generally arcuate path until the spacing again increases to a point whereat the ball will be released and thrown. If these ball-contacting members are supported for rotation about substantially horizontal axes, the ball will be propelled therefrom in substantially a vertical plane in a direction determined by the precise angular disposition of the opposed ball-contacting members, which accordingly, can be adjusted so as to throw the ball in a more upward trajectory for fly-ball practice or more downwardly to provide ground-ball practice.

In any event, it is preferred for control purposes and to achieve the required backspin for a straight, fast ball pitch to engage each side of the ball between the rotary discs at radially-spaced positions so that the outward radial contact will have a greater linear velocity than the inner and, in turn, if the narrow ball-contacting surfaces are below the rotary axis, backspin will be imparted to the ball in its thrown trajectory, thus to simulate the straight fast ball as desired.

As an obvious alternative, if the narrowed spacing of the ball-contacting discs is above the axis of rotation and the rotative direction is reversed, then topspin will be imparted as desired, for example, in the propulsion of tennis balls to simulate the common topspin thereof as frequently encountered in an actual game.

To provide lateral spin in the mentioned embodiment of the invention, it is obvious that separate variable speed motors can be connected to drive the two ball-contacting members and by adjusting the differential speed of such motors, the rotative velocity of the two ball-contacting members will be varied to, in turn, impart a lateral spin to the propelled ball, thus to provide, for example, a "curve ball" or a "slider" in the case of a baseball pitch.

As a simple alternative, a single motor can be utilized for driving both of the rotary ball-contacting members with a displaced central interconnection in conjunction with different diameter members thus to create a "curve." An infinite variation in the amount of topspin, underspin, or lateral spin on any projected ball can be achieved, thus to simulate any of the conditions experienced during actual playing conditions in baseball, softball, tennis, or other games which employ balls or similar spherical objects.

BRIEF DESCRIPTION OF THE DRAWINGS

The stated objective of the invention and the manner in which it is achieved as summarized hereinabove will be more readily understood by reference to the following detailed description of several exemplary embodiments of the invention shown in the accompanying drawings wherein: by reference to the following detailed description of severl exemplary embodiments of the invention shown in the accompanying drawings wherein:

FIG. 2 is a front elevational view thereof as viewed from the right of FIG. 1 with portions of the structure broken away to show interior details, FIG. 4 is a fragmentary cross-sectional view taken along line 4—4 of FIG. 1, FIG. 5 is a sectional view taken along line 5—5 of FIG. 4.

DETAILED DESCRIPTION OF THE EXEMPLARY EMBODIMENT OF THE INVENTION

Figure 1:
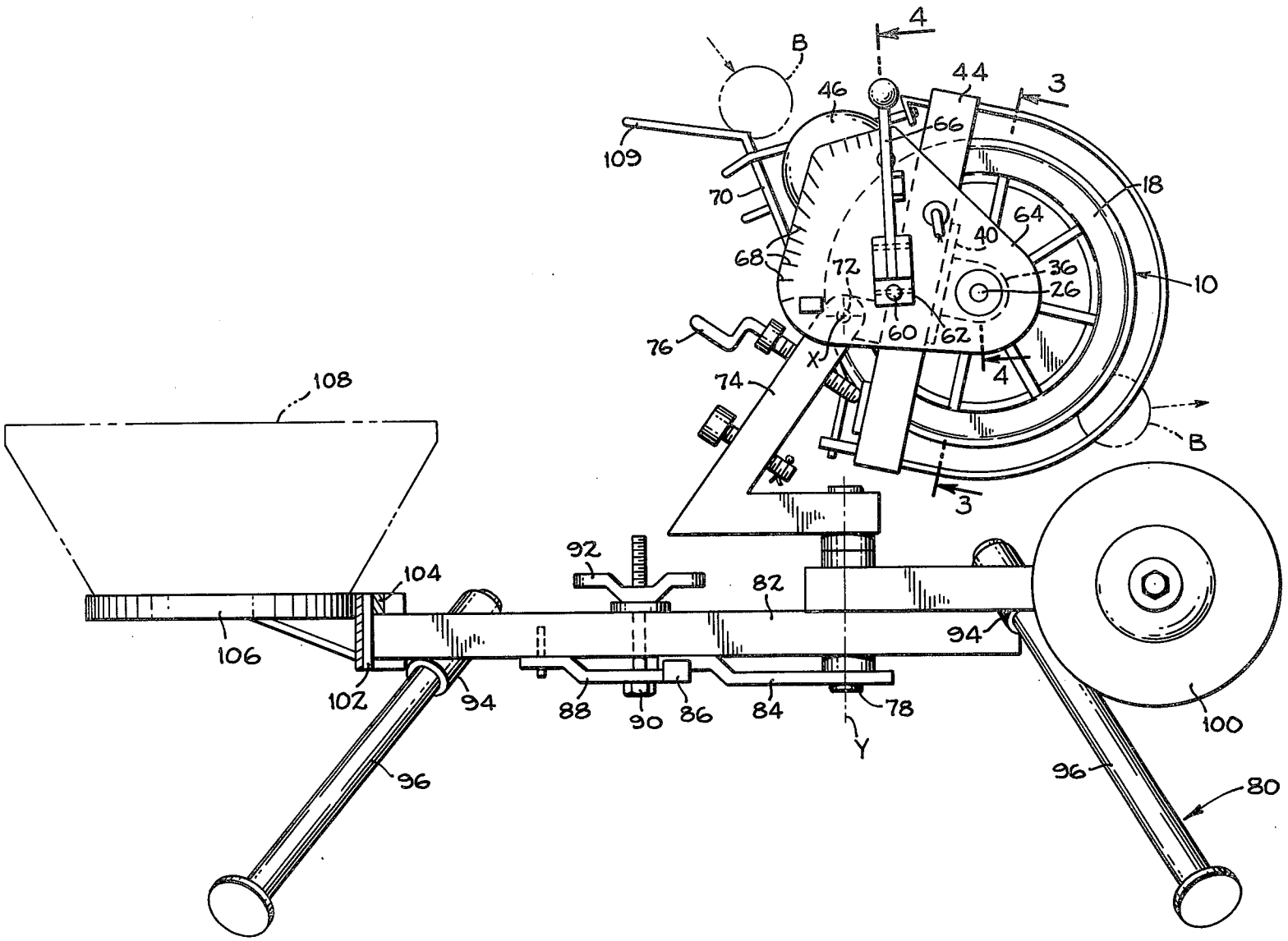
FIG. 1 is a side elevational view of a ball throwing machine embodying the present invention.
Figure 3:
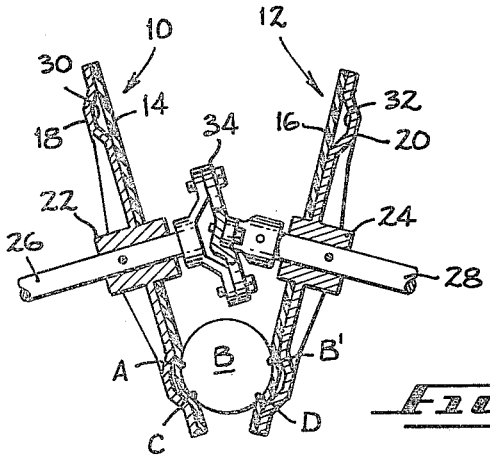
FIG. 3 is a fragmentary transverse sectional view taken along line 3—3 of FIG. 1.

With initial reference to FIGS. 1, 2, and 3, the ball throwing machine embodying the present invention is specifically arranged to throw basically "incompressible" circular objects such as baseballs or softballs along a predetermined trajectory which can be adjusted so that balls may be "pitched" to a batter for batting practice, can be thrown angularly downward so as to engage the ground for infield "grounder" practice, can be thrown angularly upwardly for "fly-ball" practice, and finally can be directed almost substantially vertically to provide "foul-ball" practice for a baseball or softball catcher. It will be obvious from a perusual of the following detailed description that this same machine either in its identical form or with certain modifications can also be used for throwing "compressible" spherical objects such as, for example, tennis balls for practice in that game endeavor.

As illustrated best in FIGS. 2 and 3, the basic ball propelling means in accordance with the present invention takes the form of a pair of rotary resilient ball-contacting members generally indicated at 10 and 12 supported and formed to provide substantially planar ball-engaging surfaces disposed in angular, opposed relationship so that the spacing between such surfaces varies between a maximum distance which is greater than the diameter of the ball B allowing introduction of the ball at one radial position and a minimum distance which is no greater than the ball diameter so that the introduced ball can be gripped and moved by the ball-contacting members 10, 12 in a generally circular path until the ball-engaging surfaces once again reach a rotary position whereat the spacing is greater than the ball diameter so that the ball can accordingly be released to be propelled along a trajectory that is substantially tangential to the circumference of the ball-contacting members.

More particularly, as most clearly shown in FIG. 3, each of the ball-contacting members 10 or 12 is formed by two sections, one of which constitutes a circular normally planar disc 14 or 16 of low friction resilient flexible plastic or rubber material, such as is commonly employed in flexible conveyor belts, that is riveted or otherwise secured to a rigid metallic backup plate 18 or 20 having an integral central hub 22 or 24 that is keyed or otherwise attached to a rotary shaft 26 or 28 at its axial center.

An annular recess or groove 30 or 32 is formed in the metal back-up plate 18 or 20 adjacent its periphery so that space is left between the rigid member 18 or 20 and the adjacent resilient section 14 or 16 as shown at the upper portion of FIG. 3 when no exterior forces are applied. On the other hand, after a ball B, such as a baseball, which is substantially incompressible is introduced between the ball-contacting members 10, 12, it will be initially engaged by the flat resilient members 14, 16 while still in their substantially flat planar dispositions, but as the ball-contacting members continue in their rotation so as to approach one another, the ball B itself will effect a depression of the resilient members into the annular grooves 30, 32 of the back-up plates 18, 20, ultimately reaching the depressed configuration shown at the bottom of FIG. 3. The radial dimension of each of these grooves 30, 32 is such that it, when conjoined with the particular thickness of the resilient ball-engaging sections, forms an arc with a shorter radius of curvature than that of the engaging ball, thus assuring that the ball is engaged by the resilient section at radially-spaced positions such as indicated at A, B, C and D in FIG. 3. Accordingly, regardless of the particular rotative speed of the ball-contacting members, it will be clear that the linear speed at the more outward position C or D will be greater than that at the inner contact positions indicate at A or B, and if, as illustrated in FIG. 3, the closest disposition of the ball-contacting members 10, 12 is below the axis of rotation, a "backspin" will be imparted to the ball B if it is released from between the ball-contacting members at a position below the rotative axis. More specifically, for pitching a baseball B, this is the arrangement desired to achieve the desired straight, "fast" ball. It will be equally obvious that if the closest disposition of the ball-contacting members 10, 12 is above the rotative axis, the ball B will be released above such axis and in turn, will be propelled with "topspin."

Several functional factors in the described ball-propelling arrangement are to be noted. In the first place, because the resilient discs 14, 16 initially have a planar disposition, and are formed of low-frictional material, initial engagement with the ball B can be light so as to gradually bring the ball up to the rotative speed of rotary ball-contacting members 10, 12 without marring or otherwise adverse effect on the ball surface. Secondly, as the surfaces of the ball-contacting members 10, 12 converge, the ball B is automatically fed into the radial center of the grooved area, thus to assure that each ball pitched will be positioned at the same radial position and will be accelerated to precisely the same linear speed in its ultimate trajectory. Finally, the grooves 30, 32 in the back-up plates 18, 20 also provide a predetermined spacing so that each ball will be released tangentially from the rotary ball-contacting members 10, 12 at precisely the same position to assume the identical trajectory regardless of the particular rotative speed of the ball-contacting members. While the precise structure and configuration of the ball-contacting members 10, 12 can be utilized for propelling other spherical objects, such as those which are compressible, such as tennis balls, it will be apparent that the resilient sections can be eliminated if the object itself is compressible, or, in other words, resilient.

With continued reference to FIGS. 2 and 3, the mounting shafts 26, 28 extend beyond the rotary ball-contacting members 10, 12 so as to intersect at a central position, and at such position are interconnected by a flexible universal joint 34 so that both ball-contacting members rotate at precisely the same rotative speed. On the opposite remote sides of the ball-contacting members, each of the shafts 26, 28 is supported in similar spaced pillow block bearings 36, 38 mounted on the side of plates 40, 42 secured to an open rigid frame 44 so that the desired angularity between the rotary ball-contacting members is assured. For practical purposes, an angular relationship of 17° has been found desirable.

This frame 44 also supports a drive motor 46, which as best shown in FIGS. 2, 4 and 5, is interconnected to the ball-contacting member mounting shaft by a variable speed pulley and belt arrangement. More particularly, the ball-contacting member shaft 26 mounts at its extremity a variable-diameter pulley 48 about which is trained a pulley belt 50 that is also trained about a standard pulley 52 on the motor shaft 54. At an intermediate position, an idler pulley 56 is mounted for rotation at one end of a crank arm, 58, the other end of which is secured to one end of a rod 60 which extends through a bearing 62 in a side housing 64 for connection at its extremity to a speed adjustment handle 66. When the speed adjustment handle 66 is moved from the substantially upright position shown in FIG. 1, in a counterclockwise direction, the idler pulley 56 will be moved from the full-line towards the dotted-line disposition shown in FIG. 5 thereby automatically decreasing the diameter of the variable-diameter pulley 48 on the ball-contacting member shaft 26 to cause the same to rotate at a higher rotative speed. The side of the housing 64 which mounts the speed control handle 66 is provided with detents 68 so that the speed can be adjusted to a number of intermediate positions between the two illustrated extremes, and since the idler pulley 56 is moved quickly from one of its adjusted positions to another when the handle is manually operated, the rotative speed of the ball-contacting members 10, 12 can be very quickly changed from one rotative speed to another, allowing the operator to quickly provide a "change-up" pitch, the time for such adjustment being normally less than two seconds.

The machine as shown in FIGS. 1 and 2 is arranged to pitch the ball B in a trajectory so that it will be presented to a batter, and as shown, the ball is manually dropped into the upper end of a feed chute 70 consisting of parallel rods that direct the ball downwardly into the space between the ball-contacting members 10, 12 which engage and accelerate the ball for ultimate tangential delivery therefrom towards the batter as clearly indicated in FIG. 1.

To provide for a lower or higher pitch or an inside or an outside pitch, means are provided for adjusting the entire ball propelling mechanism about a substantially horizontal or X axis as indicated in FIG. 2 and also about a vertical or upright Y axis as shown in both FIGS. 1 and 2. More particularly, as best shown in FIGS. 1 and 2, the entire mounting frame 44 for the ball-contacting members 10, 12 and their drive motor 46 is mounted for pivotal motion on pivot rods 72 at the top of an angularly and upwardly-extending bracket 74 and a threaded crank 76 extends through a suitable threaded opening on such bracket to engage at its extremity one element of the mounting frame 44 for the ball-contacting members, thus to vary the disposition of the mounting frame about the X axis and ultimately effect a variation in the elevation of the ball trajectory.

To provide for lateral adjustment about the substantially vertical or Y axis as shown in FIGS. 1 and 2, the described mounting bracket 74 is mounted at its lower end for pivotal motion about a vertical shaft 78 which projects upwardly from a tripod base, generally indicated at 80. The lower extremity of the shaft projects through a horizontal member 82 of the tripod base 80 and mounts a rod 84 that is laterally encompassed at its extremity by the upstanding flanges 86 of a restrictive clamp bar 88 mounted on the head at the lower end of a bolt 90 which extends upwardly through a hole in the horizontal member 82 for threaded engagement with a wing nut 92. The clamp bar 88 normally controls the amount of permissible rotation about the vertical or Y axis of the unit, but if the wing nut 92 is sufficiently loosened, the clamp bar 88 is removed from engagement with the rod 84 allowing a full 360° rotation of the entire ball-propelling mechanism.

The mentioned tripod base 80 includes three angularly-disposed sockets 94 mounted on the described horizontal member 82 which are arranged to releaseably receive three angular legs 96 forming the tripod that are secured in position by set screws 98 but can be withdrawn when the entire unit is to be stored or moved. When the front tripod legs are removed, the front end of the base 80 can be movably supported on the ground by suitable wheels 100 at opposite sides of the base member as best shown in FIG. 2, the third leg then serving as a handle for the required mobility.

Conveniently, the rear of the horizontal member 82 of the tripod base is provided with an upright flange 102 arranged to receive the socket 104 of a basket carrier 106, which can also readily be removed from such mounting when the entire unit is to be transported or stored, and as will be obvious, this basket carrier 106 can conveniently support a basket 108 with a plurality of balls therein enabling the operator to periodically remove one ball and place it in the previously described feed chute 70 for operation of the unit.

It will be apparent that the described means for adjusting the entire unit on the base about the upright Y axis and the horizontal X axis will control the elvation or transverse trajectory of a pitch. It should also be mentioned that with suitable downward adjustment of the ball propelling means, ground balls can be thrown, or alternatively, if the ball propelling means is adjusted about the X axis upwardly, fly balls can be delivered for outfield practice and if even further adjusted upwardly substantially vertical trajectories can be obtained to provide the catcher with practice for "foul-tips."

In turn, if lateral adjustments about the upright Y axis are made, the grounders, flyballs, or pop-ups can be delivered to various players during practice. All such adjustments can be made quickly and easily by an operator adjustment of the supported unit through manual grasping of a handle 109 formed at the upper extremity of the feed chute.

Figure 6:
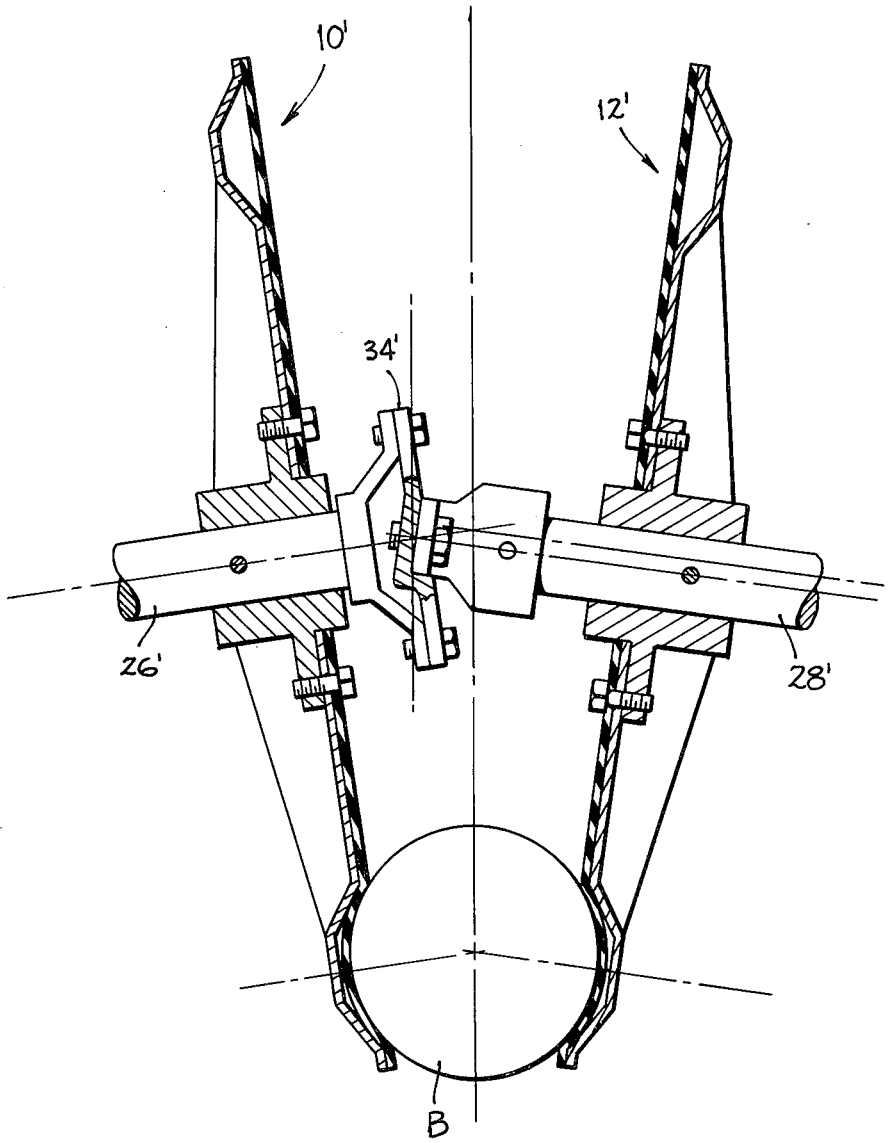
FIG. 6 is an enlarged fragmentary sectional view corresponding to FIG. 3 of a modified arrangement of the ball-contacting members.

It is obvious that the drive mechanism for the unit described hereinabove provides for adjustable but like rotary speed of the two ball-contacting members, but a slight modification as shown in FIG. 6 will provide lateral rotation of the propelled ball thus to enable the throwing of a "curve" or "slider." The structure is generally similar to that described and as a consequence, corresponding parts will be indicated by the same reference numerals with an added prime notation. However, the two ball-contacting members 10', 12' are of slightly different diameters and are supported on shafts 26', 28' which meet at a non-central or axially eccentric disposition. As a consequence, the radial ball-contacting positions have differing radial dimensions so that the circumferential speed differs to impart the desired lateral spin even though but one drive motor be utilized and the shaft rotative speeds are the same.

Figure 7:
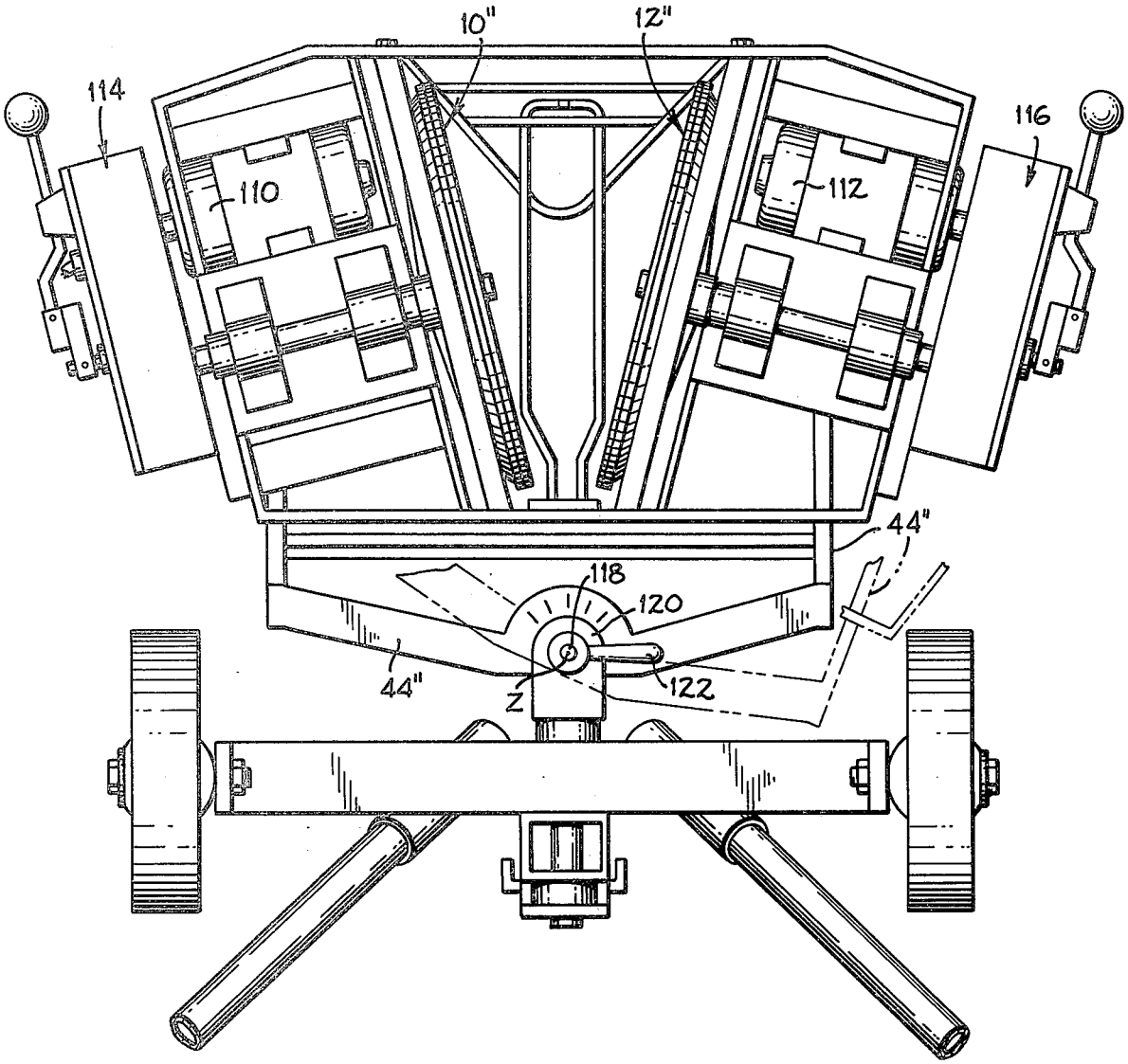
FIG. 7 is a view similar to FIG. 2 of another modified embodiment of the invention.

As a further modification, as shown in FIG. 7, it is obvious that two like ball-contacting members 10'', 12'' identical to those of the first embodiment can be utilized if energized independently by two separate motors 110, 112 each connected by a variable speed control lever and mechanism 114, 116 similar to the one described in connection with the first embodiment of the invention so that details of such construction and operation will not be repeated. It will be apparent that the central universal interconnection 34 between the two ball-contacting members is rendered unnecessary, and additionally, as shown in FIG. 7, the mounting frame 44'' for the ball-contacting members and their associated motors and drive mechanisms is also mounted for pivotal adjustment about a second substantially horizontal Z axis and as indicated in FIG. 6, such adjustment is simply made by supporting the mounting frame 44'' on a horizontal shaft 118 extending in the Z direction in a suitable bearing 120 with a threaded end that receives a clamping lever 122 which secures the mounting frame for the ball-contacting members 10'', 12'' in the desired adjusted disposition about the Z axis, thus enabling production of "curves" or "sliders" which move in different upward or downward directions towards the batter.

Various other modifications and or alterations from the structures as shown and described are obviously possible within the general scope of the invention and the foregoing description of but three embodiments is accordingly to be considered as purely exemplary and not in a limiting sense and the actual scope of the invention is to be indicated only by reference to the appended claims.

What is claimed is:

1. A ball throwing machine which comprises a pair of rotary resilient ball-contacting members having angularly-opposed ball-contacting surfaces whose spacing varies between a maximum distance greater than the ball diameter and a minimum distance no greater than the ball diameter, and means for rotating said ball-contacting members, said rotary ball-contacting members each including a resilient section and a rigid back-up plate section cooperatively arranged to provide, in contact with the ball to be projected, a concentric depressed annular groove means at a preset position which precisely controls the point of tangential release of the ball for throwing thereof.

2. A ball throwing machine according to claim 1 wherein said rotary ball-contacting members are disposed so that the minimum distance therebetween lies above their axes of rotation.

3. A ball throwing machine according to claim 1 wherein said rotary rigid plate section has continuous annular groove means providing spaced relation from said resilient section in the absence of exterior forces for receiving the resilient section when a ball to be projected has forced the latter section inwardly.

4. A ball throwing machine which comprises a pair of rotary resilient ball-contacting members having angularly-opposed substantially planar ball-engaging surfaces whose spacing varies between a maximum distance greater than the diameter of a ball to be projected and a minimum distance no greater than the diameter of a ball to be projected, and means supporting said ball-contacting members on rotary shafts connected for correlated rotative motion, said rotary shafts being supported for rotation about non-common axes and connected by a rotary universal coupling to provide such correlated rotative motion.

5. A ball throwing machine which comprises a pair of rotary ball-contacting members having angularly-opposed ball-contacting surfaces whose spacing varies between a maximum distance greater than the diameter of a ball being projected and a minimum distance no greater than the diameter of a ball being projected, said ball-contacting members being rotatively supported on shafts whose axes intersect each other at a position to one side of a plane passing centrally through a ball to be projected and which is equidistant between the angled members, said ball-contacting members engaging a ball at different radial positions on said members, and means for rotating said ball-contacting members at the same rotative speed.

6. A ball throwing machine according to claim 5 wherein said ball-contacting members have different ball-contacting diameters, and said rotating means includes a pair of angularly-disposed and connected shafts supporting said ball-contacting members at different axial positions.

7. A ball throwing machine which comprises a pair of rotary ball-contacting members having angularly-opposed ball-contacting surfaces whose spacing varies between a maximum distance greater than the diameter of a ball being projected and a minimum distance no greater than the diameter of a ball being projected, said ball-contacting members being rotatively supported on shafts whose axes intersect each other at a position to one side of a plane passing centrally through a ball to be projected and which is equidistant between the angled members, said ball-contacting members engaging a ball at different radial positions on said members, and means for rotating said ball-contacting members.

* * * * *